US009188381B2

(12) United States Patent
Derosier

(10) Patent No.: US 9,188,381 B2
(45) Date of Patent: Nov. 17, 2015

(54) METHOD AND APPARATUS FOR INITIATING COIL DEFROST IN A REFRIGERATION SYSTEM EVAPORATOR

(71) Applicant: Evapco, Inc., Taneytown, MD (US)

(72) Inventor: Greg Derosier, Taneytown, MD (US)

(73) Assignee: EVAPCO, INC., Taneytown, MD (US)

( * ) Notice: Subject to any disclaimer, the term of this patent is extended or adjusted under 35 U.S.C. 154(b) by 112 days.

(21) Appl. No.: 14/221,694

(22) Filed: Mar. 21, 2014

(65) Prior Publication Data

US 2014/0283538 A1 Sep. 25, 2014

Related U.S. Application Data

(60) Provisional application No. 61/804,045, filed on Mar. 21, 2013.

(51) Int. Cl.
*F25D 21/02* (2006.01)
*F25D 21/00* (2006.01)

(52) U.S. Cl.
CPC ..... *F25D 21/02* (2013.01); *F25B 2700/11* (2013.01); *F25D 21/006* (2013.01)

(58) Field of Classification Search
CPC .... F25D 21/02; F25D 21/006; F25B 2700/11
See application file for complete search history.

(56) References Cited

U.S. PATENT DOCUMENTS

| | | | |
|---|---|---|---|
| 4,045,971 | A | 9/1977 | Brenner, Jr. |
| 4,123,792 | A | 10/1978 | Gephart |
| 4,232,528 | A | 11/1980 | Behr |
| 4,344,293 | A | 8/1982 | Fujiwara et al. |
| 4,400,949 | A | 8/1983 | Kinoshita et al. |
| 4,736,635 | A | 4/1988 | Murase |
| 4,831,833 | A | 5/1989 | Duenes et al. |
| 5,156,012 | A | 10/1992 | Kuribara et al. |
| 5,410,887 | A | 5/1995 | Urata et al. |
| 6,192,696 | B1 | 2/2001 | Shimamoto et al. |
| 6,264,898 | B1 | 7/2001 | Ingram |
| 6,715,304 | B1 | 4/2004 | Wycoff |

(Continued)

FOREIGN PATENT DOCUMENTS

| | | |
|---|---|---|
| WO | 2010/077893 | 7/2010 |
| WO | 2012062329 | 5/2012 |

OTHER PUBLICATIONS

International Search Report issued in corresponding International Application No. PCT/US2014/031424 on Aug. 21, 2014.

(Continued)

*Primary Examiner* — Ljiljana Ciric
*Assistant Examiner* — Alexis Cox
(74) *Attorney, Agent, or Firm* — Whiteford, Taylor & Preston, LLP; Peter J. Davis

(57) ABSTRACT

A system for controlling the defrost cycle of an evaporator comprising a sensor in the coil of an evaporator or downstream of the coil, the sensor configured to determine changes in the liquid mass ratio of the refrigerant in the evaporator. The difference in liquid mass ratio relating to frost buildup on the outside of said evaporator. When the difference in liquid mass ratio reaches a predetermined amount, corresponding to an unsatisfactory frost buildup, a defrost cycle is initiated. When the liquid mass ratio returns to a value that corresponds to a defrosted evaporator, the defrost cycle is discontinued.

10 Claims, 6 Drawing Sheets

(56) References Cited

U.S. PATENT DOCUMENTS

| | | | |
|---|---|---|---|
| 7,628,080 | B1 | 12/2009 | Feller |
| 2002/0088238 | A1 | 7/2002 | Holmes et al. |
| 2009/0199635 | A1 | 8/2009 | Jacobson et al. |
| 2011/0214438 | A1 | 9/2011 | Larsen et al. |
| 2012/0047987 | A1 | 3/2012 | Asada et al. |
| 2013/0291568 | A1 | 11/2013 | Elstroem |

OTHER PUBLICATIONS

International Search Report issued in International Application No. PCT/US15/29528 on Aug. 4, 2015.

METHOD AND APPARATUS FOR INITIATING COIL DEFROST IN A REFRIGERATION SYSTEM EVAPORATOR

FIELD OF THE INVENTION

This invention relates primarily to industrial or commercial refrigeration systems. Specifically, this invention relates to systems for detecting an accumulation of frost on an evaporator and initiating a defrost cycle when the accumulation of frost reaches unacceptable levels.

BACKGROUND OF THE INVENTION

Conventional refrigeration systems achieve cooling by allowing a refrigerant such as ammonia or a fluorocarbon to evaporate in the coils of an evaporator. As the refrigerant evaporates, it absorbs heat from the surrounding area. A fan or other air moving device is used to draw air through the evaporator so that heat is removed more effectively from the air in the space that is being refrigerated.

As the temperature in the evaporator is generally below the freezing point of water, water vapor in the air often condenses on the evaporator coils and solidifies as frost. The buildup of frost adversely affects the cooling efficiency of the evaporator due to two cooperating factors. First, frost is a thermal insulator. The thicker the frost layer on the evaporator coils, the less efficient the heat transfer between the air and the evaporator. In addition, the buildup of frost restricts the air flow through the evaporator coils. As a result, less air is cooled. Eventually, as frost builds up, the combined effects of reduced air flow and reduced heat transfer require that the evaporator be defrosted to restore cooling efficiency.

One method for defrosting evaporators in prior systems has been to defrost them automatically and periodically under timed control. The time between the defrost cycles is set by an operator based on experience with the system.

Other prior systems have tried to initiate defrost cycles only when the frost buildup is large enough to adversely impact the cooling efficiency of the refrigeration system. In U.S. Pat. No. 4,123,792, a system is described which measures the power consumed by an electric fan motor which draws air over the evaporator. The principle of operation of this system is that frost buildup on the evaporator impedes air flow. As frost builds, the motor works harder to drive the fan, and when a particular set point for power consumption by the fan is reached, the system presumes that defrost is required and a defrost cycle is initiated. Other systems, such as that shown in U.S. Pat. No. 4,400,949, also use information regarding fan motor power consumption but combine that information with information regarding the temperature of the refrigerated space and the temperature of the unit cooler to determine whether defrost is required.

Other frost detection systems such as those shown in U.S. Pat. Nos. 4,045,971 and 4,232,528, employ photoelectric sensors to detect the level of frost buildup on an evaporator coil. The system in U.S. Pat. No. 4,831,833 uses an air velocity sensor in the air flow path to determine whether defrost should be initiated.

Another prior art system senses the differences in air temperature on each side of the evaporator in the refrigerated space as well as the temperature of the refrigerant leaving the evaporator. The data from the sensors is processed to determine if there is a frost buildup requiring the initiation of the defrost cycle.

SUMMARY OF THE INVENTION

The various prior art systems described above all suffer from limitations that the present invention is designed to overcome in order to create a system that can determine more precisely when defrost is required. In this way the defrost cycle is only initiated when it is necessary considering the operator's priorities with respect to power consumption, cooling efficiency and other factors.

The problem with prior art timed defrost systems is that the amount of water vapor in the air in the refrigerated area varies depending on a number of factors. Some of these factors include the humidity in the environment surrounding the space being cooled, the number of times the access door to the refrigerated area is opened, and the duration of such openings. The temperature in the area being cooled, the temperature of the evaporator, the velocity of the air passing through the evaporator and the evaporation of water from items stored in the cooled area, are all factors that also affect the rate of frost buildup. Usually, timed defrost systems must be set for the severe conditions when frost will accumulate most rapidly. When conditions are not so severe, there are unnecessary defrost cycles which waste energy and cost money. Conversely, if the timer is set for modest conditions, and actual conditions are more severe, then defrost cycles could be delayed beyond when they are needed thereby compromising system performance.

The problem with systems that initiate defrost cycles based on power consumption, such as that disclosed in the '792 and '949 patents, is that factors other than frost buildup also impact the power requirements for a fan motor. Such factors include the supply voltage, the temperature in the cooled space, and the age of the motor. The system described in the '949 patent also has the disadvantage that the characteristics of refrigeration system components vary with age and loss of refrigerant. Such a system cannot compensate for these factors.

The problem with frost detection systems that rely on photoelectric sensors, such as that disclosed in the '971 patent, is that they are only capable of sensing frost at a particular location on an evaporator. As frost buildup is not always regular or uniform, frost may build at locations away from the photoelectric sensor and not be detected. This will cause the evaporator to operate inefficiently because defrosting may be needed even though it is not detected due to the location of the sensors. In other situations frost may build up near the sensor to a greater extent than at other locations causing defrost to be initiated when it is not needed. Another deficiency of such systems is that they may not detect the buildup of transparent, clear ice. The system in the '833 patent suffers from similar location-dependent deficiencies.

The problem with systems that rely on temperature differences on each side of the evaporator, and the temperature of the refrigerant as it leaves the evaporator, is that they are complex, and changes in temperature across the evaporator indicative of frost buildup may occur in other situations as well. In addition, such systems cannot compensate for changes that occur with age or loss of refrigerant.

Accordingly, the inventors determined that there exists a need for a frost detection system that is more accurate, reliable and less expensive to implement than existing systems and which is unaffected by changes in the system due to changes in system components, or age or loss of refrigerant.

The present invention is an improved method and system for detecting and preventing the capacity reduction impact of frost building on a coil surface. As discussed above, prior methods have relied on air side pressure increase, surface frost optical detection, air side temperature change with time, fan power increase or other external measures that indirectly indicate frosted coil performance reduction. This invention relies on detecting a change in the amount of internal refrigerant liquid that is evaporated by the heat exchanger, and/or changes in the ratio of refrigerant liquid to refrigerant vapor. The invention may be used to initiate coil defrost in any evaporating refrigerant cooling system, including direct expansion and liquid overfeed evaporators.

In an overfeed evaporator coil, more liquid is introduced into the coil than is evaporated by the coil. The excess liquid is called overfeed, which returns to the low pressure side accumulator. By overfeeding the evaporator, the inner surface is kept thoroughly wetted and thus achieves optimum heat transfer.

In an evaporating refrigerant cooling system, the ratio of liquid refrigerant to evaporated refrigerant in the vapor phase is referred to as the liquid mass ratio. As the coil builds frost on its exterior, the evaporative efficiency declines, and as the evaporative efficiency declines, less refrigerant is evaporated, and the liquid mass ratio increases. According to the invention, the liquid mass ratio is measured with a suitable sensor, including but not limited to a void fraction sensor. The sensor produces an output signal that is reflective of the amount of liquid in the refrigerant flow stream. When the system is fully defrosted, e.g., at start-up, or after a full defrost, the sensor and its control system can measure a first or initial or full defrost liquid mass ratio, and use that ratio as the starting point for determining the trigger point for a defrost cycle. As a coil builds frost, the liquid mass ratio increases. When the increase in liquid mass ratio exceeds a specified value, that is, a predetermined increase over the first/initial/full defrost value, a control will signal that defrost of the coil is required. The system can initiate defrost automatically upon receipt of such signal, or can be configured to alert a system operator to manually authorize system defrost.

After the coil defrosts fully, the control system may optionally measure the liquid mass ratio, compare it to a first/initial liquid mass ratio and/or to a previous full defrost liquid mass ratio, and optionally use the new ratio, or optionally an average of prior full defrost liquid mass ratios, to use as the starting point for determining the trigger point for the next defrost cycle. In this way the system can be dynamic as it constantly adjusts to actual site and system conditions, and thus takes into account such factors as the age and possible loss of refrigerant. In the case of a liquid overfeed evaporator, the control system can also use input from the liquid mass ratio sensor to detect if an evaporator is operating at an optimum overfeed rate. The overfeed rate may not be optimum due to liquid feed valve settings or a reduction in heat transfer unrelated to frost on the coil.

The operator can manipulate the trigger point to meet specific requirements based on system priorities. The defrost trigger point might be set low (e.g., when the liquid mass ratio is 5% over the first/initial/full defrost liquid mass ratio), when just a little bit of frost is starting to form, if high performance/efficiency (frost inhibits performance) is required. Alternatively, the defrost trigger point might be set higher if some capacity loss is acceptable and/or fewer defrost cycle events is desired.

According to one embodiment of the invention, there is provided a frost detection system for an evaporator which senses frost buildup by measuring the liquid mass ratio in or exiting from the evaporator coil. According to a preferred embodiment of the invention, a liquid mass ratio sensor is located in the evaporator coil. According to another embodiment of the invention, a liquid mass ratio sensor is located between the evaporator coil and the compressor.

According to one embodiment of the invention, there is provided a frost detection system which need not take into account temperature in the refrigerated area.

According to one embodiment of the invention, there is provided a frost detection system that need not take into account changes in the operating characteristics of the refrigeration equipment due to aging.

According to one embodiment of the invention, there is provided a frost detection system that assumes that the heat load is constant. According to another embodiment of the invention, the frost detection system may be provided with a device that measures the heat load of the system, for example the air temperature into the coil relative to coil saturation temperature or the total flow rate of refrigerant (both liquid and vapor), and the heat load information is used to adjust the defrost point for specific liquid mass ratios detected by the liquid mass ratio sensor.

According to one embodiment of the invention, there is provided a frost detection system that is more accurate, reliable and less expensive to implement that existing systems.

According to one embodiment of the invention, there is provided a method for controlling and/or initiating the defrost cycle of an evaporative coil having the following steps: detecting the ratio of liquid refrigerant to refrigerant in a vapor phase; and initiating a defrost cycle when the ratio of liquid refrigerant to vapor phase refrigerant equals or exceeds a predetermined amount. The predetermined amount may be changed according to operator preference. According to this and other embodiments of the invention, a first ratio of liquid refrigerant to vapor phase refrigerant may be determined when said evaporative coil has no frost. According to other embodiments, a defrost cycle may be initiated when the detected liquid to vapor mass ratio is an amount higher (e.g., 5%, 10%, 15%) than said first liquid to vapor mass ratio.

According to one embodiment of the invention, there is provided a method for controlling and/or initiating the defrost cycle of an evaporator having the following steps: detecting a first capacitance between charged plates situated in the coil of an evaporator, or downstream of the coil; detecting a second capacitance between the charged plates; and initiating a defrost cycle when a difference between the first capacitance and the second capacitance equals or exceeds a predetermined amount. The predetermined amount may be changed according to operator preference. According to this and other embodiments of the invention, the difference between said first capacitance and said second capacitance corresponds to a difference in volumes of fluid passing between said charged plates. According to further embodiments of the invention, the first capacitance is determined when said evaporator has little or no frost.

According to a preferred embodiment, the method is used in a liquid overfeed evaporator, but it may also be used in other systems including direct expansion systems.

According to another embodiment of the invention, there is provided an apparatus for initiating coil defrost in an evaporator, the apparatus including a refrigerant evaporating heat exchange coil and a sensor for detecting the ratio of liquid refrigerant to refrigerant in a vapor phase. Said sensor may be located in said coil, or between said coil and a condenser of said evaporator, more particularly between said coil and a compressor of said evaporator, and more particularly between said coil and a separator of said evaporator.

According to a preferred embodiment of the invention, the refrigerant evaporating heat exchange coil is in a liquid overfeed evaporator.

According to another embodiment of the invention, there is provided an apparatus for initiating coil defrost in a refrigeration system, the apparatus including a refrigerant evaporating heat exchange coil and a liquid mass ratio sensor located in the coil, or downstream of said coil, wherein said liquid mass ratio sensor is a capacitance sensor. According to this embodiment, the liquid mass ratio sensor may include a plurality (two or more) of spaced apart conductive elements conductively connected to a current source. According to this embodiment, the sensor detects changes in capacitance due to changes in the amount of liquid between the spaced apart conductive elements. According to a further embodiment of the invention, the liquid mass ratio sensor is a parallel plate sensor. According to yet a further embodiment of the invention, the liquid mass ratio sensor is made of parallel plates configured to receive a charge, and where the sensor is configured to take capacitance readings that reflect a volume of liquid passing between the plates of the sensor. According to various other embodiments of the invention, the conductive elements may take the form of coils, cylinders, or other shapes. According to a preferred embodiment of the invention, the conductive elements of the sensor may be in the form of parallel concentric cylinders.

DESCRIPTION OF THE DRAWINGS

The subsequent description of the preferred embodiments of the present invention refers to the attached drawings, wherein.

DETAILED DESCRIPTION OF THE INVENTION

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
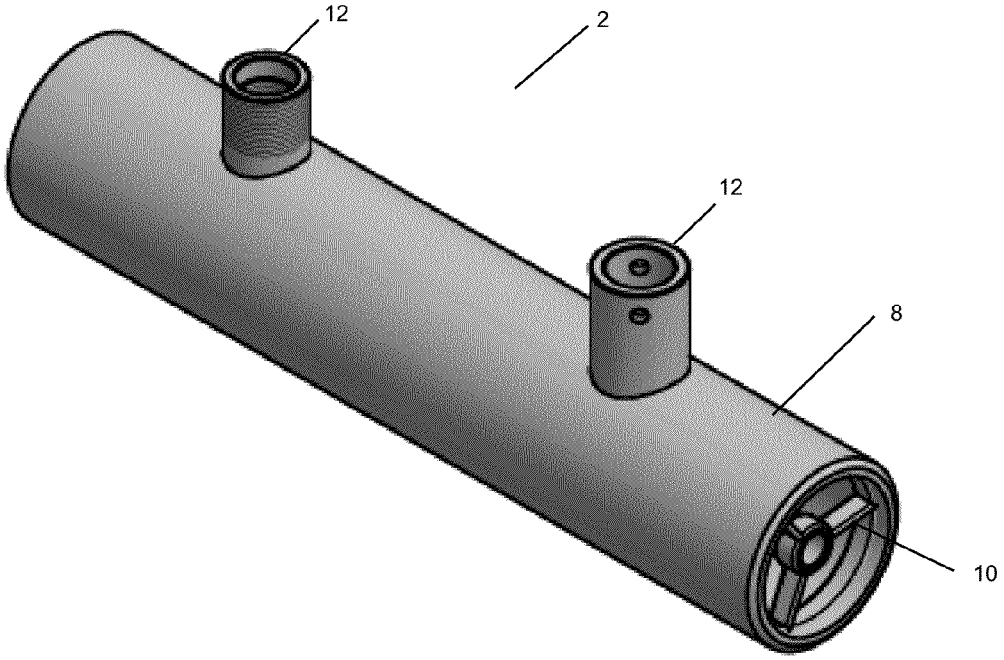
FIG. 1 shows a perspective view of a sensor according to an embodiment of the invention.

FIG. 1 shows a sensor 2 according to one embodiment of the invention. The sensor shown in FIG. 1 works on the basis of capacitance change due to the amount of liquid refrigerant between two charged plates. As mentioned above, this is only one embodiment of the invention according to which the amount of liquid refrigerant in the coil or leaving the coil may be determined according to any number of known methods.

Figure 2:
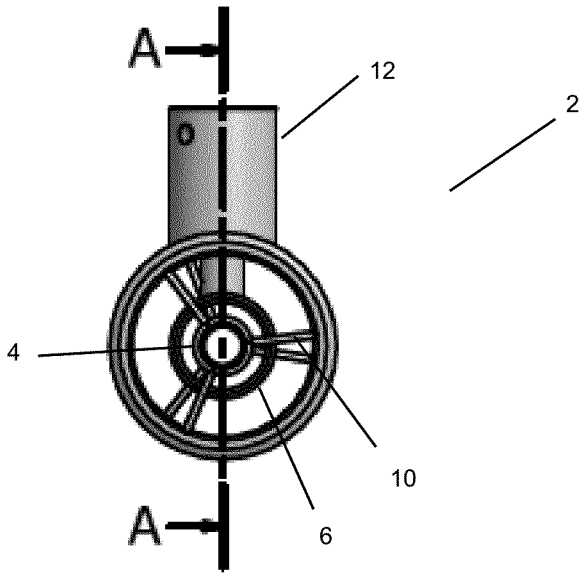
FIG. 2 shows an end view of the sensor shown in FIG. 1.
Figure 3:
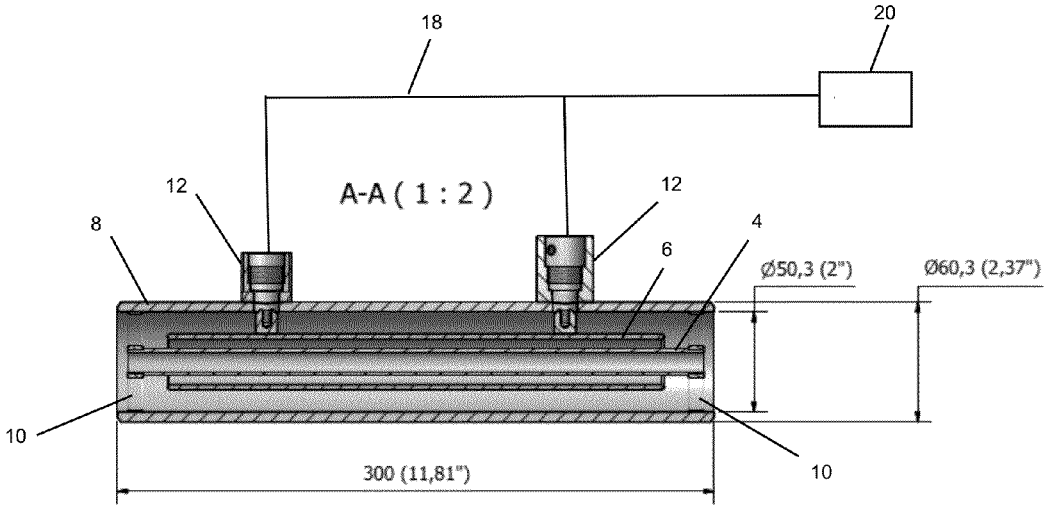
FIG. 3 shows a cross-sectional view of the sensor shown in FIGS. 1 and 2.

According to the embodiment of FIG. 1, the capacitance sensor includes charged plates in the form of concentric cylinders, 6 and 8, see FIGS. 2 and 3. The sensor shown in FIGS. 1-3 is a 2-inch HBDX-SAM-Mark void fraction sensor (in gas-liquid two-phase flow, the void fraction is defined as the fraction of the flow-channel volume that is occupied by the gas phase or, alternatively, as the fraction of the cross-sectional area of the channel that is occupied by the gas phase). The HBDX-SAM-Mark sensor may be purchased from HB Products of Denmark, but any sensor that detects capacitance change between charged elements due to changes in the amount of liquid between them can be used according to the capacitance detection embodiment of the invention. Cylinder 6 is held in the refrigerant flow path of cylinder 8 (which may also serve as the sensor housing) by stacks 12. Stacks 12 are conductively connected to charged cylinders 6 and 8. As the liquid refrigerant quantity increases, the capacitance increases. The capacitance change, which is very small, is detected by a sophisticated electronic circuit 18 and then output in a useable signal to control system 20. According to an alternate embodiment, the sensor may include additional concentric cylinder 4, held in the refrigerant flow path of cylinder 8 by supports 10, and capacitance changes between cylinders 4 and 6, between cylinders 4 and 8, or between cylinders 4, 6 and 8 may be used to compare changes in the amount of liquid between them over time.

Figure 4:
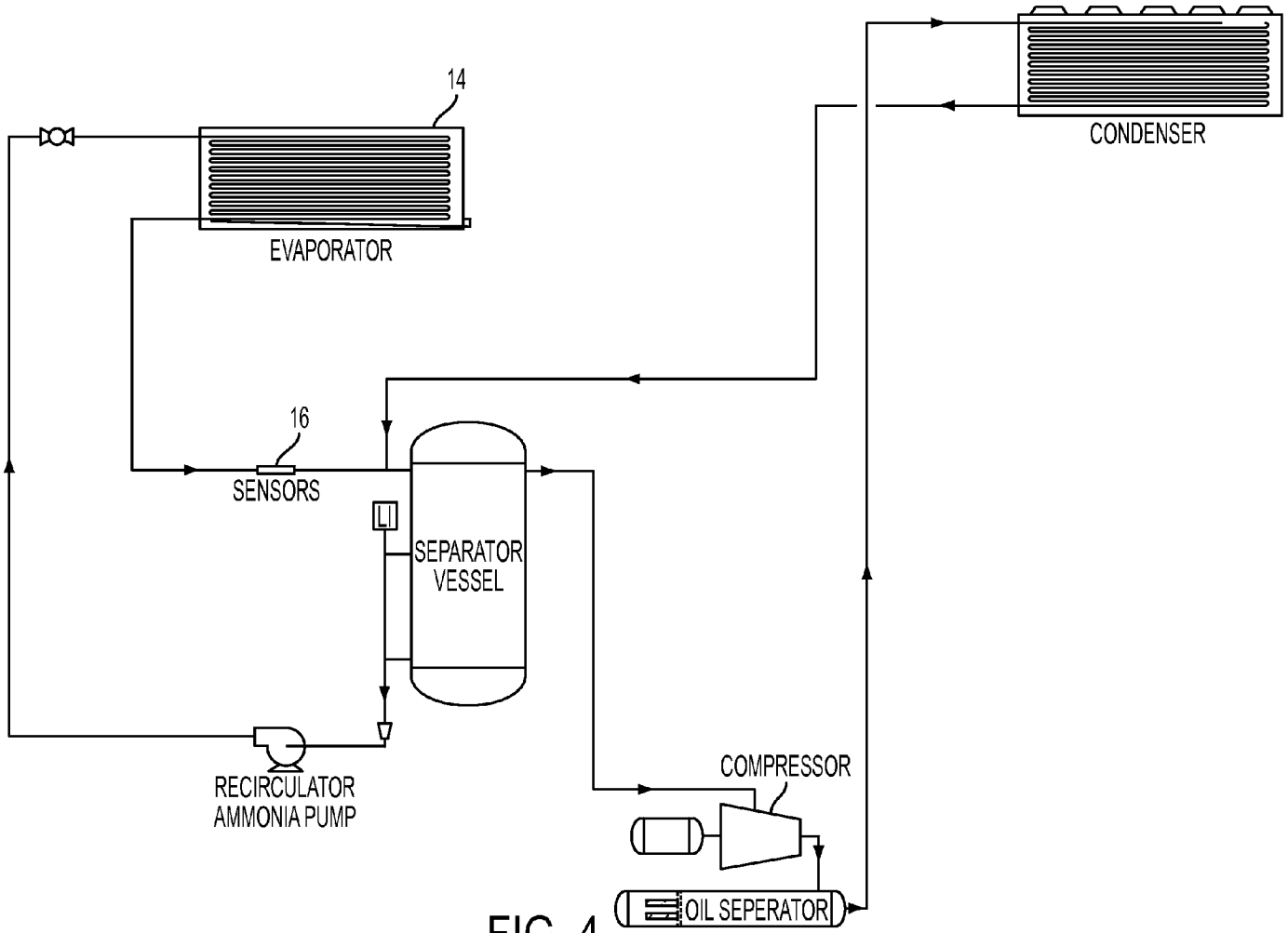
FIG. 4 is a representation of a refrigerant evaporating cooling system having a sensor according to an embodiment of the invention.
Figure 5:
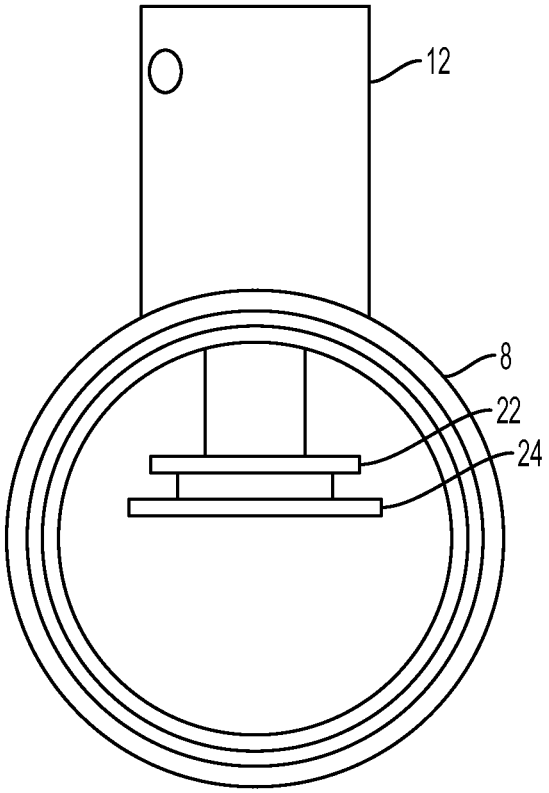
FIG. 5 shows an end view of a sensor according to an alternate embodiment having charged plates 22 and 24.
Figure 6:
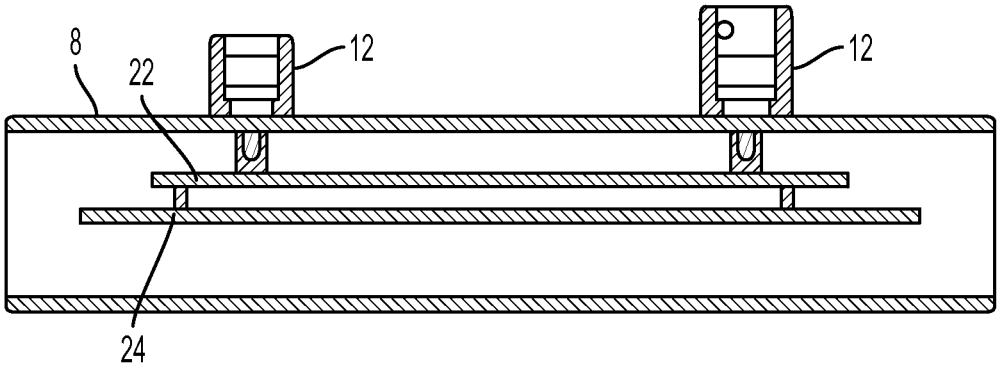
FIG. 6 shows a cross-section view of the sensor shown in FIG. 5.

According to a preferred embodiment, the liquid mass ratio sensor of the invention, whether a capacitance sensor or other liquid mass ratio sensor, may be placed in the coil of the evaporator 14 (see FIG. 4), or it may be placed downstream of the evaporator, for example at location 16. The sensor orientation may be vertical, horizontal or some other angle. Whatever the orientation, the sensor is preferably exposed to the liquid and vapor flow in the evaporator or downstream of the evaporator, and the sensor response is reflective of actual changes in the amount of liquid refrigerant evaporated.

The user may select a particular sensor output for defrost initiation depending on the cost of initiating a defrost cycle (cost of system down-time) relative to the savings gained through capacity increase as a result of defrost. The selected point for defrost initiation may vary with evaporator application and to user sensitivity to cost and/or efficiency. It is estimated that the capacity reduction (loss of cooling power/efficiency) due to frost effects can range from 5% to 25% or more. Thus, depending on costs of defrost versus importance of efficiency for particular applications, the system of the invention may be set to initiate a defrost cycle when the sensor detects a change in the liquid mass ratio of 5%, 10%, 15%, 20% or more, which may correspond to reductions in capacity of anywhere from 5% to 25%.

Having now set forth exemplary embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A method for controlling the defrost cycle of an evaporator, comprising:

detecting a first capacitance between two spaced-apart conductive elements situated in said evaporator or downstream of said evaporator;

detecting a second capacitance between said two spaced-apart conductive elements; and initiating a defrost cycle for said evaporator when a difference between said first capacitance and said second capacitance equals or exceeds a predetermined amount.

2. A method according to claim 1, wherein:

said spaced-apart conductive elements comprise two charged plates.

3. A method according to claim 1, further comprising detecting a third capacitance between said two spaced-apart conductive elements, and stopping a defrost cycle for said evaporator when said third capacitance is the same or within a predetermined amount of said first ratio.

4. A method according to claim 1, wherein said first capacitance is determined when said evaporator has no frost.

5. A method according to claim 1, wherein said difference between said first capacitance and said second capacitance corresponds to a difference in volumes of liquid passing between said spaced-apart conductive elements.

6. A method according to claim 1, wherein said predetermined amount may be changed according to operator preference.

7. A method according to claim 1, wherein said spaced-apart conductive elements are concentric cylinders in a refrigerant flow path of said evaporator.

8. An evaporating refrigerant cooling system comprising an evaporator coil, a liquid mass ratio sensor located in said coil or downstream of said coil, and a control system configured to initiate a coil defrost cycle when said liquid mass ratio sensor outputs a value that equals or exceeds a predetermined value and to discontinue said defrost cycle when said liquid mass ratio sensor outputs a second value that is equal to or less than a second predetermined value, wherein said liquid mass ratio sensor comprises conductive elements configured to receive a charge, said sensor configured to take capacitance readings reflective of a volume of fluid passing between said spaced-apart conductive elements.

9. An apparatus according to claim 8, wherein said spaced-apart conductive elements comprise two concentric cylinders.

10. An apparatus according to claim 8, wherein said spaced-apart conductive elements comprise two plates.

* * * * *